US005379203A

United States Patent [19]

Marano

[11] Patent Number: 5,379,203

[45] Date of Patent: Jan. 3, 1995

[54] ILLUMINATED STILT APPARATUS

[76] Inventor: Patricia A. Marano, 3313 McIntyre Dr., Murrysville, Pa. 15668

[21] Appl. No.: 121,531

[22] Filed: Sep. 16, 1993

[51] Int. Cl.[6] ..... F21V 33/00

[52] U.S. Cl. ..... 362/253; 362/102

[58] Field of Search ..... 362/102, 109, 157, 103, 362/253; 482/1, 75, 76

[56] References Cited

U.S. PATENT DOCUMENTS

| | | | |
|---|---|---|---|
| 31,210 | 1/1861 | Johnson . | |
| D. 204,281 | 4/1966 | Phaneuf . | |
| D. 255,468 | 6/1980 | Ricca et al. . | |
| 680,454 | 8/1901 | Garretson | 482/75 |
| 2,242,748 | 5/1941 | Fulwiler | 482/75 |
| 2,245,349 | 6/1941 | Lombardi | 362/102 |
| 3,201,876 | 8/1965 | Leuml . | |
| 4,071,243 | 1/1978 | Fink . | |
| 4,875,142 | 10/1989 | Spector | 362/202 |
| 5,222,929 | 6/1993 | Duda | 482/1 |

FOREIGN PATENT DOCUMENTS

| | | | |
|---|---|---|---|
| 646219 | 11/1928 | France | 482/75 |

*Primary Examiner*—Richard R. Cole
*Attorney, Agent, or Firm*—Rhodes & Ascolillo

[57] ABSTRACT

A stilt apparatus, the stilt apparatus including an elongated column member, a horizontal foot hold formed on the elongated column member for supporting the foot of an individual, the elongated column member including an elevation member extending downward from the horizontal foot hold, the elongated column member additionally including a graspable support member extending upward from the horizontal foot hold, and an illumination mechanism for illuminating at least one of a portion of the elongated column member and a portion of the horizontal foot hold.

4 Claims, 3 Drawing Sheets

ILLUMINATED STILT APPARATUS

BACKGROUND

1. Field of the Invention

The present invention relates to the field of stilt apparatuses that enable an individual to walk in an elevated position.

2. Description of the Related Art

U.S. Pat. No. 4,071,243 relates to a pair of stilts in which each stilt includes a horizontally positionable elongate handle that has first and second ends from which elongate members extend downwardly and upwardly, each downwardly extending elongate member terminating on the lower end in a projecting step that has a centered third member projecting downward therefrom.

U.S. Pat. No. 3,201,876 relates to a pair of oversized toy boots to be worn by young children as stilt-like platforms.

U.S. Pat. No. 31,210 relates to stilts that have horizontal foot holds with upward and downward columns extending from the horizontally opposite ends thereof.

U.S. Pat. No. Des. 255,468 relates to an ornamental design for a stilt that simulates the appearance of, for example, an animal's foot.

U.S. Pat. No. Des. 204,281 relates to an ornamental design for a stilt.

SUMMARY OF THE INVENTION

Stilts, which enable an individual to walk in an elevated position, have been used for entertainment purposes for many years, and children continue to be amused by them. The present invention is directed toward even further enhancing the enjoyment that can be derived from this apparatus.

To this end, one object of the present invention is the provision of a stilt apparatus that includes a device for illuminating portions of the stilt, thereby increasing its visual impact.

Another object of the invention is the provision of such a stilt apparatus wherein the illuminating device is readily accessible for repair or for replenishing the batteries powering same.

Yet another object of the invention is the provision of such a stilt apparatus that is simple in construction and operation and, therefore, inexpensive to manufacture.

In one aspect, the invention generally features a stilt apparatus, the stilt apparatus including: an elongated column member; a horizontal foot hold formed on the elongated column member for supporting the foot of an individual; the elongated column member including an elevation member extending downward from the horizontal foot hold; the elongated column member additionally including a graspable support member extending upward from the horizontal foot hold; and an illumination mechanism for illuminating at least one of a portion of the elongated column member and a portion of the horizontal foot hold.

Preferably, the illumination mechanism includes a housing member, the housing member being insertable within a cavity provided in the elongated column member, the housing member substantially enclosing the illumination mechanism therein: the cavity is provided in the graspable support member; the graspable support member is provided with a plurality of light passing channels communicating from the cavity to an exterior surface of the graspable support member; the illumination mechanism includes a battery powered electric bulb; the cavity is disposed adjacent an upper portion of the graspable support member; the illumination mechanism includes a housing member, the housing member being insertable within a cavity provided in the horizontal foot hold, the housing member substantially enclosing the illumination mechanism therein; and the horizontal foot hold is provided with a plurality of light passing channels communicating from the cavity to an exterior surface of the horizontal foot hold.

In another aspect, the invention generally features a stilt apparatus, the stilt apparatus including: an elongated column member: a horizontal foot hold projecting outward from the elongated column member: the elongated column member including an elevation member extending downward from the horizontal foot hold and a graspable support member extending upward from the horizontal foot hold; a cavity provided in the elongated column member; at least one light passing channel communicating from the interior of the cavity to an exterior surface of the elongated column member; and a self-powered illumination mechanism disposed within the cavity; the self-powered illumination mechanism including: a housing insertable into and removable from the cavity; an electric bulb disposed within the housing; a battery disposed within the housing for powering the electric bulb; and a switch mechanism for controlling the flow of electricity from the battery through the electric bulb.

Preferably, the cavity is disposed within the graspable support member; the cavity is disposed within an upper portion of the graspable support member; and the switch mechanism includes an electric switch disposed on an exterior surface of the insertable and removable housing.

In yet another aspect, the invention generally features a stilt apparatus, the stilt apparatus including: an elongated column member: a horizontal foot hold projecting outward from the elongated column member: the elongated column member including an elevation member extending downward from the horizontal foot hold and a graspable support member extending upward from the horizontal foot hold; a cavity provided in the horizontal foot hold; at least one light passing channel communicating from the interior of the cavity to an exterior surface of the horizontal foot hold; and a self-powered illumination mechanism disposed within the cavity; the self-powered illumination mechanism including: a housing insertable into and removable from the cavity; an electric bulb disposed within the housing; a battery disposed within the housing for powering the electric bulb; and a switch mechanism for controlling the flow of electricity from the battery through the electric bulb.

Preferably, the switch mechanism includes an electric switch disposed on and exterior surface of the insertable and removable housing.

The invention will now be described by way of a particularly preferred embodiment, reference being made to the accompanying drawings, wherein:

DESCRIPTION OF THE PREFERRED EMBODIMENT

Figure 1:
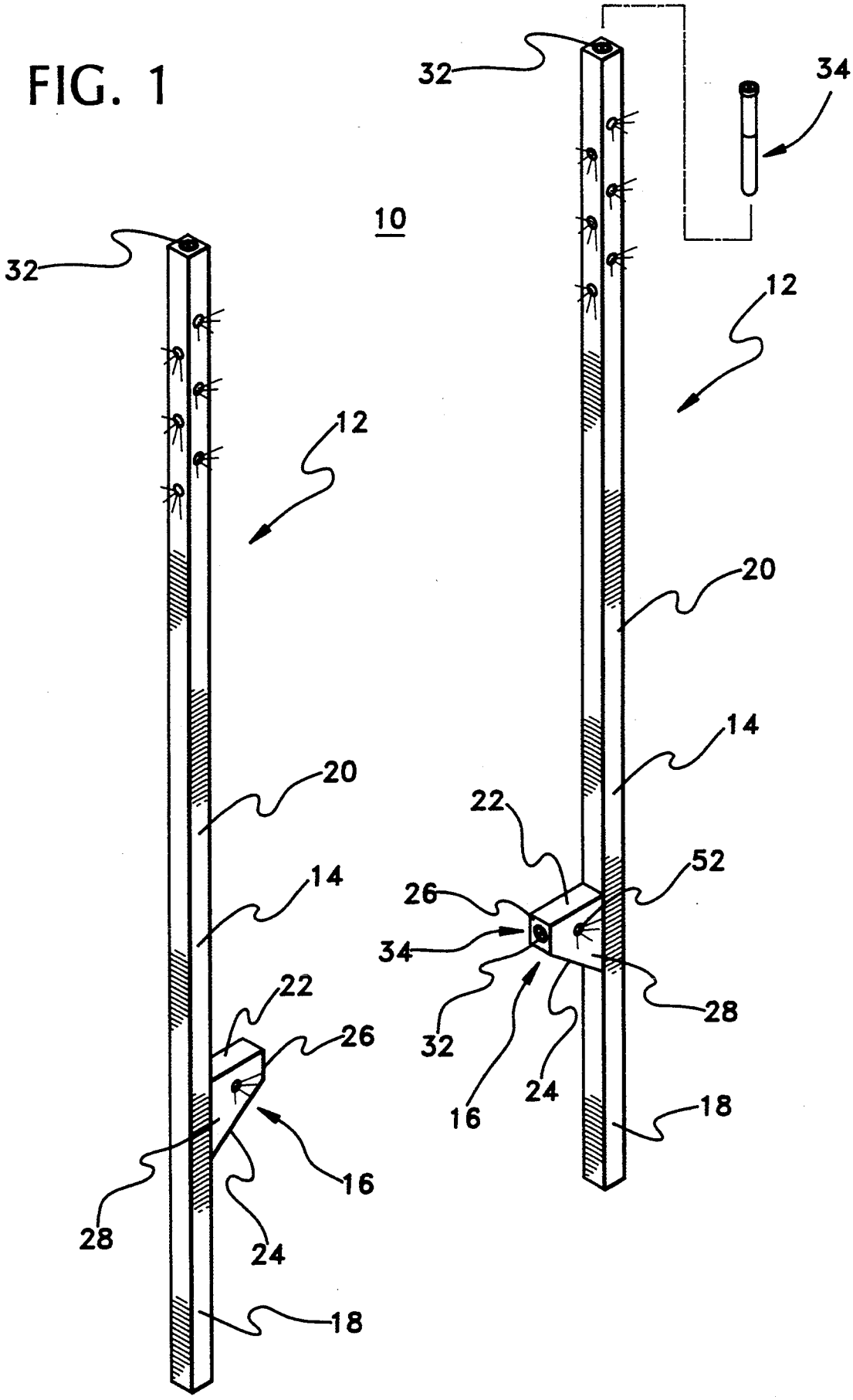
FIG. 1 is a perspective view of a pair of stilts constructed according to the present invention.

Referring initially now to FIG. 1, a stilt apparatus 10 that is constructed according to the present invention includes a pair of stilts 12, each of the pair of stilts 12 generally including an elongated column member 14 having a horizontal foot hold 16 projecting therefrom. Each of the column members 14, in turn, is made up of an elevation member 18 extending downward from the horizontal foot hold 16 and a graspable support member 20 extending upward from the horizontal foot hold 16. In the preferred embodiment shown in the drawings, each elongated column member 14 is preferably constructed in the form of a substantially straight shaft member, having a substantially rectangular or square cross section, and each horizontal foot hold 16 is preferably constructed in the form of a truncated right angle triangle shaped member affixed to and projecting outward from the shaft member at a point approximately one fourth the total height of the shaft member. However, it is to be understood that stilts having elongated column members 14 and horizontal foot holds 16 of various other shapes and dimensions are seen as falling within the scope of the present invention.

Each horizontal foot hold 16, as noted above, is preferably in the form of a truncated right angle triangle shaped member and has a substantially horizontal upper face 22, a slanted lower face 24, a substantially vertical outer face 26, and a truncated side face 28.

The inventive stilt apparatus 10 additionally includes at least one illuminating device in the form of a cavity 32 provided in either a portion of the elongated column member 14, the horizontal foot hold 16, or in both of the elongated column member 14 and the horizontal foot hold 16, as shown in FIG. 1, and a self-powered illuminating apparatus 34 that is insertable into and removable from the cavity 32.

Figure 2:
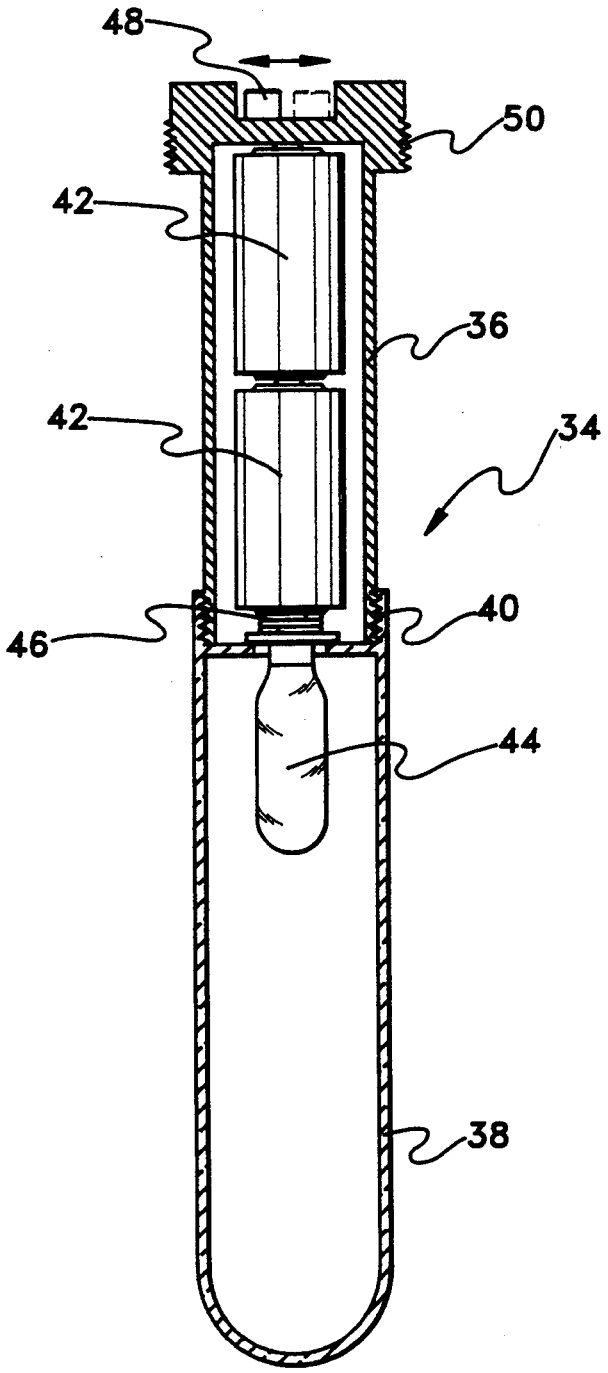
FIG. 2 is a cross sectional view of an illumination device that is used in the inventive stilts of FIG. 1.
Figure 3:
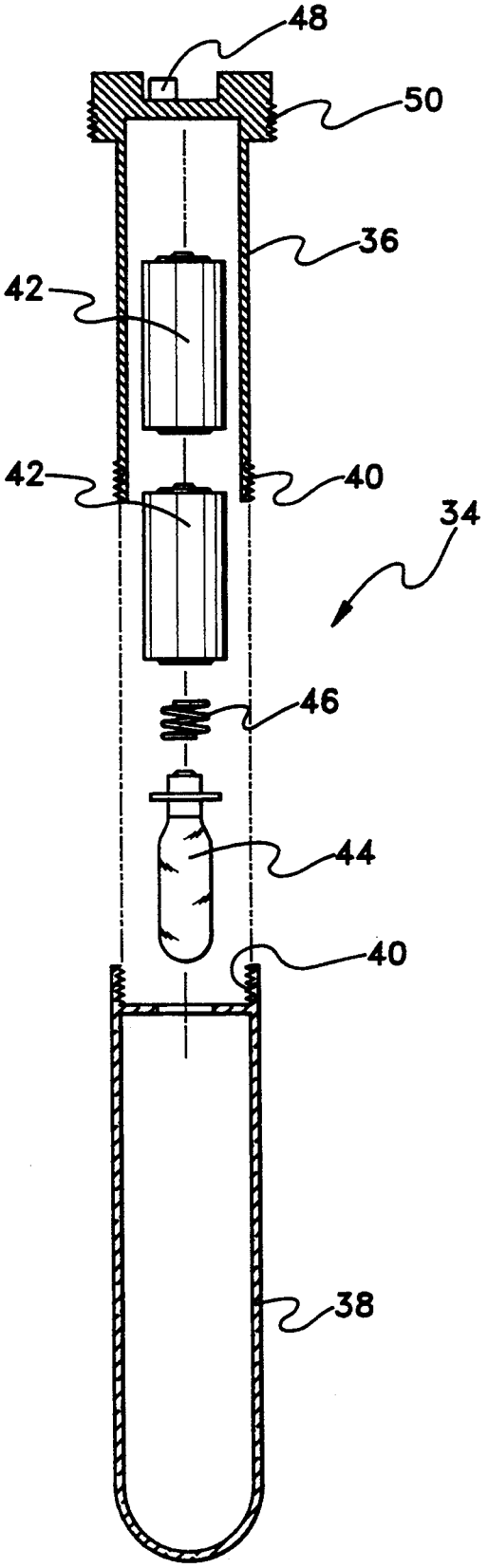
FIG. 3 is an exploded cross sectional view of the illumination device of FIG. 2.

The self-powered illuminating apparatus 34, which is shown in more detail in FIGS. 2 and 3, generally preferably includes a housing, which in turn includes a cylindrical base housing member 36 and a transparent or at least translucent housing member 38, the two housing members 36 and 38 attaching to one another via threads 40, a pair of conventional batteries 42, an electric bulb 44, a spring 46 acting to bias the batteries 42 and bulb 44 into contact with one another, and a switch 48 disposed on an exterior end of the base housing member 36. The base housing member 36 is additionally provided with external threads 50 that permit the self-powered illuminating apparatus 34 to be inserted and removed from the cavity 32 that is provided in either or both of the elongated column member 14 and the horizontal foot hold 16. The switch 48 allows the electric bulb 44 to be turned on and off.

Figure 4:
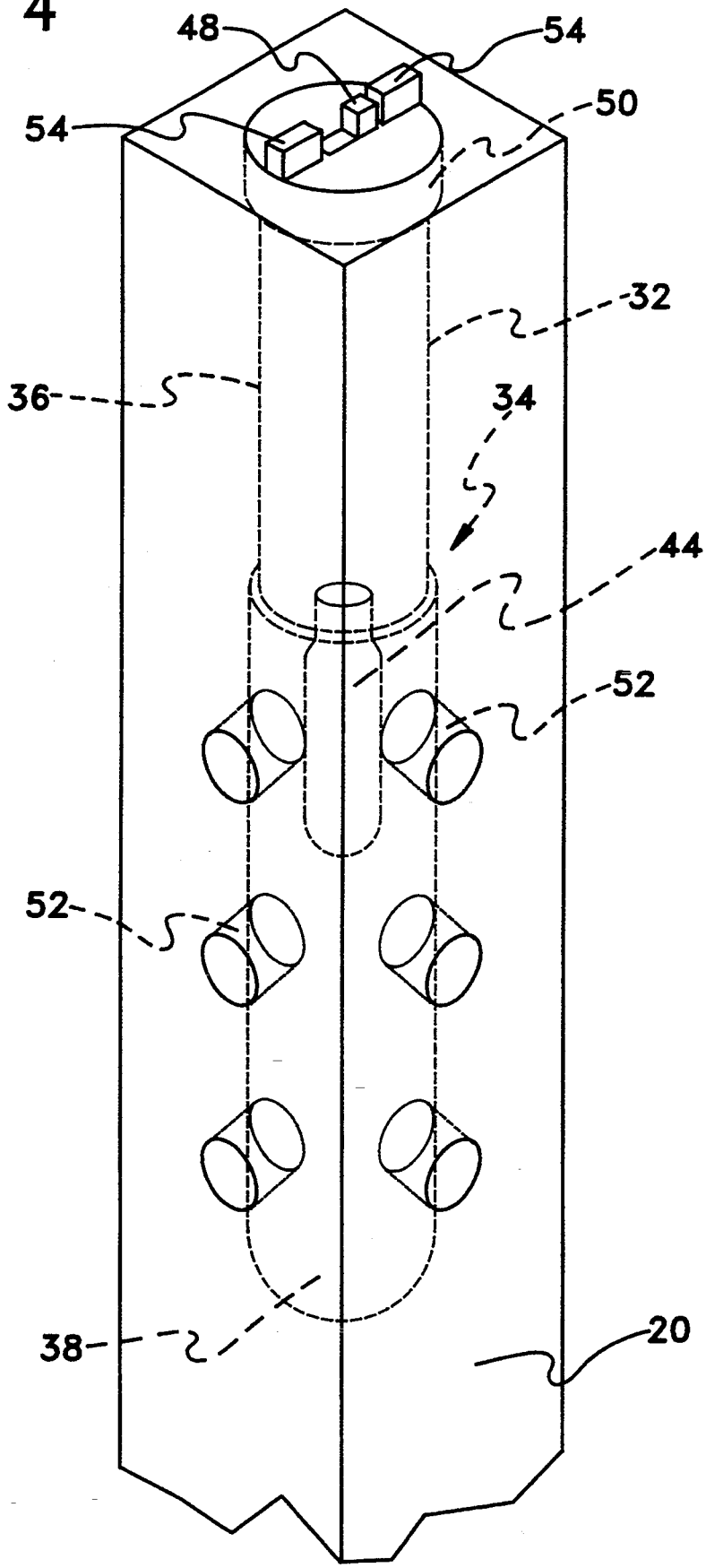
FIG. 4 is a perspective of an upper portion of one of the inventive stilts, showing the mounting of the illumination device within a cavity provided therein.

Referring now to FIG. 4, in the embodiment wherein the self-powered illuminating apparatus 34 is positioned within the cavity 32 provided in the upper portion of the graspable support member 20, the graspable support member 20 is additionally provided with at least one, and preferably a plurality, of throughgoing channels 52 extending from the cavity 32 to an exterior surface of the graspable support member 20. Additionally, it will be seen from FIG. 4 that the exposed outer surface of the base housing member 36 has two spaced outstanding studs 54 provided thereon, by means of which the self-powered illuminating apparatus 34 can be threadingly inserted into and removed from the cavity 32 via the threads 50. FIG. 4 additionally shows the switch 48 positioned between the studs 54 and therefore easily accessible when the self-powered illuminating apparatus 34 is positioned within the cavity 32.

Referring back to FIG. 1, when the self-powered illuminating apparatus 34 is provided within the horizontal foot hold 16, the horizontal foot hold 16 itself, and preferably the truncated triangular lateral faces 28 of each of the horizontal foot holds 16, is provided with at least one throughgoing channel 52 extending from the cavity 32 to an exterior surface of the horizontal foot hold 16.

With the self-illuminating apparatus 34 installed and activated in either or both of the elongated column 14 and the horizontal foot hold 16, the appearance of the pair of stilts 12 is enhanced.

While the invention has been herein described by way of a particular preferred embodiment, various substitutions of equivalents may be effected without departing from the spirit and scope of the invention as set forth in the following claims.

What is claimed is:

1. A stilt apparatus, said stilt apparatus comprising:

a pair of elongated linear column members;

a horizontal foot hold projecting outwardly from each of said elongated linear column members;

said elongated linear members each comprising an elevation member extending downward from said horizontal foot hold and a graspable support member extending upward from said horizontal foot hold;

a cavity provided in each elongated linear column member;

a cavity provided in each horizontal foot hold;

at least one light passing channel communicating from the interior of each of said cavities to an exterior surface of each elongated linear column member and each horizontal foot hold;

self-powered illumination means disposed within each of said cavities;

said self-powered illumination means comprising:

a housing insertable into and removable from said cavity;

a pair of spaced, outstanding studs disposed on an outside surface of said housing;

an electric bulb disposed within said housing;

a battery disposed within said housing for powering said electric bulb: and switch means for controlling the flow of electricity from said battery through said electric bulb.

2. A stilt apparatus according to claim 1, wherein said cavity is disposed within said graspable support member.

3. A stilt apparatus according to claim 2, wherein said cavity is disposed within an upper portion of said graspable support member.

4. A stilt apparatus according to claim 3, wherein said switch means comprises an electric switch disposed on an exterior surface of said insertable and removable housing.

* * * * *